US005894795A

United States Patent [19]

Gagne et al.

[11] Patent Number: 5,894,795

[45] Date of Patent: Apr. 20, 1999

[54] APPARATUS AND METHOD FOR PREVENTING CONDENSATION IN MACHINES PROCESSING A WEB OF MATERIAL

[75] Inventors: Daniel Paul Gagne, S. Berwick, Me.; Charles Douglas Lyman, Pelham, N.H.

[73] Assignee: Heidelberger Druckmaschinen, Heidelberg, Germany

[21] Appl. No.: 08/993,999

[22] Filed: Dec. 18, 1997

[51] Int. Cl.[6] ..... B41F 7/26; B41F 7/37; B41F 13/22

[52] U.S. Cl. ..... 101/148; 101/487

[58] Field of Search ..... 101/148, 147, 101/216, 487, 488, 350.1, 363, 364, 207–210; 62/175, 201, 176.6

*Primary Examiner*—J. Reed Fisher
*Attorney, Agent, or Firm*—Kenyon & Kenyon

[57] ABSTRACT

An apparatus and method for preventing condensation in a selected area of a printing press, for example a dampener system, by, for example, controlling the air temperature surrounding the dampener system by cooling, heating or changing the humidity of the air such that the temperature difference between the components of the dampener system and the surrounding air has a desired value.

6 Claims, 2 Drawing Sheets

APPARATUS AND METHOD FOR PREVENTING CONDENSATION IN MACHINES PROCESSING A WEB OF MATERIAL

BACKGROUND INFORMATION

1. Field of the Invention

The present invention relates to an apparatus and method for preventing condensation in machines processing web-like material. More particularly, the present invention relates to an apparatus and method for preventing condensation in a printing press by controlling temperatures in an area of a printing unit of a printing press.

2. Description of the Related Art

In print shops and press testing facilities there has been a problem that on high-speed machines, condensation occurs on those safety elements, such as finger guards, vital to protecting the press operating staff as well as on other sub-systems of the printing press. Condensation on a guard can be, for example, in the form of droplets on the surfaces which can collect to form drops dripping either onto the surface of the web-type material to be printed upon or into the printing unit itself, thereby causing print defects and other undesirable conditions. Condensation below the web-type material can cause print defects as well, for example, when droplets drip onto surfaces of vibrator rollers or the like of a lower printing unit.

Even on other printing unit components such as shields, rails, frame parts or tail tuckers, condensation may also occur in the form of droplets dripping on the web or on components of the ink train, thus posing a risk for maintaining print quality. For example, condensation of water on the surface of print unit rolls, especially the rolls in the dampening system of a printing press, can have a detrimental effect on the water feed in the lithographic printing process—condensed water added to the dampening solution on a roll can exceed the capacity of the nip resulting in excess water build-up and excess water in the nip can result in unstable water feed, thereby reducing print quality. Indeed, drips onto the web can cause direct lithographic errors and condensation on a roll, especially dampener rolls, can destabilize the lithographic process.

It is an object of the present invention to prevent defects on printed material from a printing press due to condensation. It is another object of the present invention to maintain the air temperature surrounding a selected area of a printing press to prevent condensation.

SUMMARY OF THE INVENTION

According to an exemplary embodiment of the present invention, undesired condensation in a selected area of a printing press, for example a dampener system, is controlled by, for example, controlling the air temperature surrounding the dampener system by cooling and heating the air (thereby also changing the humidity of the air) such that the temperature difference between the components of the dampener system and the surrounding air has a desired value and creates a substantially isothermal condition.

BRIEF DESCRIPTION OF THE DRAWINGS

The foregoing and other features of the present invention will become apparent to those skilled in the art upon reading the following description of preferred embodiments of the invention in view of the accompany drawing, wherein.

DETAILED DESCRIPTION OF THE INVENTION

Figure 1:
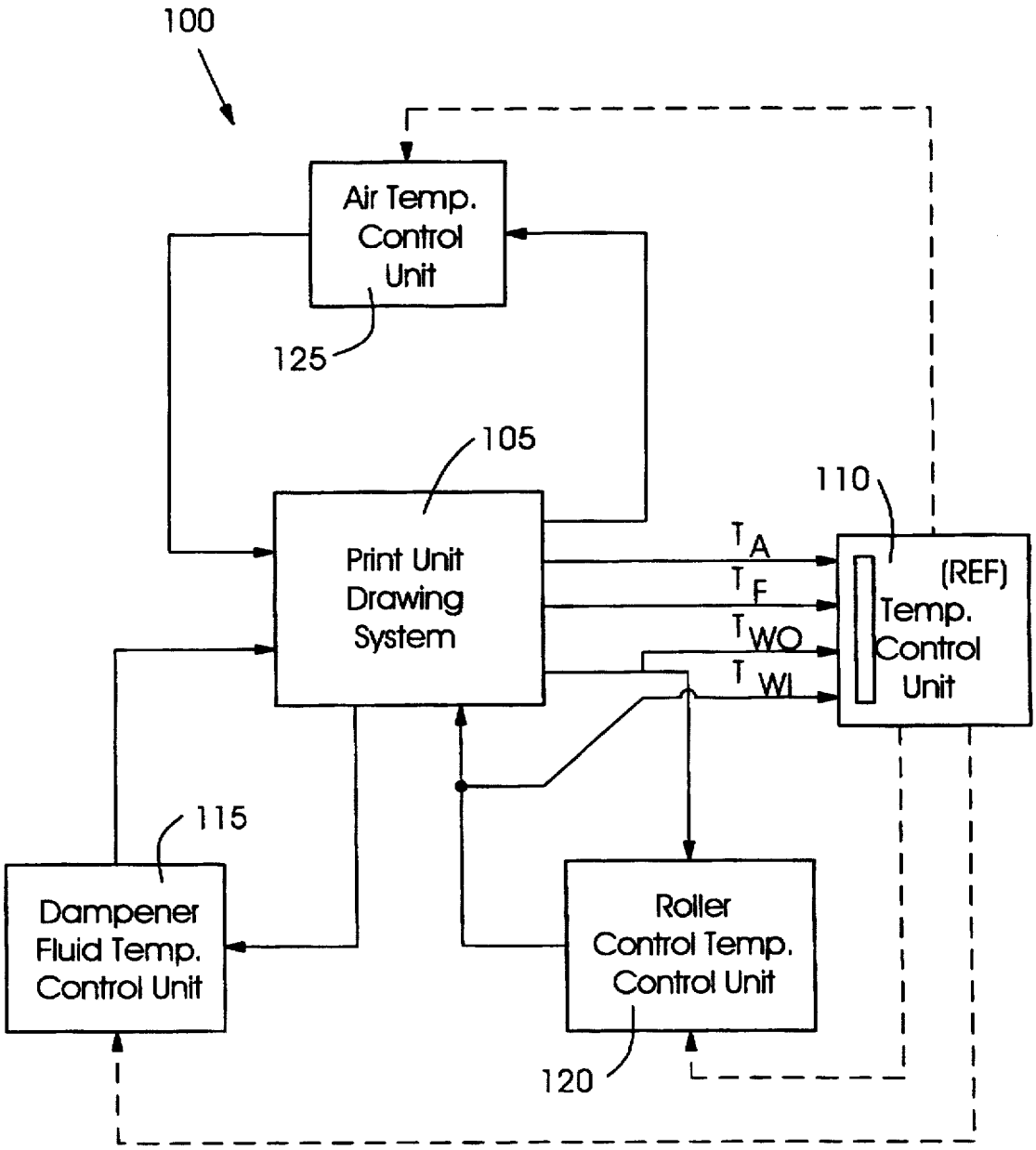
FIG. 1 is an exemplary illustration of an isothermal dampener system according to the present invention.

FIG. 1 illustrates an isothermal dampener system according to the present invention. In a conventional dampening system, such as described in U.S. Pat. Nos. 5,592,880 and 5,520,113, which are expressly incorporated herein by reference, excess water may form on the dampening system roller due to the high relative humidity and temperature differential from the atmosphere to the roller surface. The excess water in the dampener due to condensation may cause the delivery of dampening solution to, for example, the printing plate to be inconsistent.

In the isothermal dampener system according to the present invention, however, more consistent delivery of dampening solution to the printing plate is provided by, for example, controlling the temperature of the dampening system rollers, the temperature of dampening fluid and the temperature of the air in the area of the dampening system to be substantially equal via a temperature control unit 110, as illustrated in FIG. 1.

For example, air temperatures slightly less than or slightly greater than the temperature of the dampening fluid and dampening roller are acceptable. This would allow, for example, a small amount of condensation or evaporation which will not cause lithographic problems. Thus, for air temperatures slightly lower than the temperature of the dampening fluid and the dampening roller surface temperature, a low and acceptable level of evaporation of dampening fluid into the air can occur. Similarly, for air temperatures slightly greater than the temperature of the dampening fluid and dampening roller surface temperature, a low and acceptable level of condensation onto the roller surface can occur. Thus, the result of maintaining temperatures in such an acceptable range will result in, for example, a consistent delivery of dampening solution to the printing plate.

As shown in FIG. 1, an exemplary isothermal dampening system 100 according to the present invention includes a temperature control unit 110 connected to a conventional printing unit dampening system 105. The printing unit dampening system 105, may include, for example, a multiplicity of rollers and cylinders via which a dampening solution is applied to a printing form, such as a printing plate on a print cylinder of a conventional web-offset printing press. The printing unit dampening system 105 may be enclosed or isolated from ambient air conditions by, for example, enclosing the dampening system 105 or print unit in a box or similar structure. The entire printing unit including the isothermal dampening system 100 could also be enclosed or isolated from ambient air conditions if desired.

The temperature control unit 110 may include, for example, a programmable control unit 110*a*, such as a conventional microprocessor based control unit, that receives, for example, a signal $T_A$ representing ambient air temperature of the print unit dampening system 105, a signal $T_F$ representing the dampening fluid temperature, a signal $T_{wo}$ representing the roller cooling water outlet temperature and a signal $T_{WI}$ representing the roller cooling water inlet temperature.

Also connected to the print unit dampening system 105 is the dampener fluid temperature control unit 115 which may include, for example, a pump and related plumbing to circulate the dampening fluid to the dampening system 105, a tank to hold a reservoir of dampening fluid, and a heater/chiller unit to control the temperature of the dampening fluid temperature by, for example heating or cooling the tank of dampening fluid via conventional methods to maintain a constant temperature of the dampening fluid.

A roller cooling water temperature control unit 120 is also connected to the print unit dampening system 105 and may include, for example, a pump and related plumbing to circulate fluid through dampener system rollers, a tank to hold a reservoir of, for example, water, and a heater/chiller unit to control the temperature of the water into the dampener roller(s). The air temperature control unit 125, also connected to the print unit dampening system 105, may include, for example, a fan to circulate air through the enclosed unit (e.g., the dampening system 105), a heater to increase the air temperature as directed by the temperature control unit 110 and a chiller to decrease the air temperature as directed by the temperature control unit 110, for example, using a conventional heating, ventilation and air conditioning (HVAC) system.

The programmable control unit 110*a* of the temperature control unit 110 receives the input signals $T_A$, $T_F$, $T_{wo}$ and $T_{WI}$ and outputs a control signal determined as a function of the input signals and a reference temperature $T_{REF}$. The signals $T_A$, $T_F$, $T_{WO}$ and $T_{WI}$ can be provided from either a sensor measuring each of the respective values in the print unit dampening system 105 or, for example, from a sensor measuring each of the values in the dampener fluid temperature control unit 115 or the roller cooling water temperature control unit 125, respectively. For example, the temperature of the dampener fluid, which flows in both the dampening system 105 and the dampener control unit 115, could be measured at either the print unit dampening system 105 or at the dampener fluid temperature control unit 115, and then provided to the temperature control unit 110.

$T_{REF}$ represents a reference temperature for the isothermal dampener system according to the present invention. $T_{REF}$ can be, for example, a predetermined value, such as a temperature based on the experience of the printing unit operator to provide optimal operating conditions, such as a 72° F. running temperature for the dampener system. Alternatively, $T_{REF}$ can be determined, for example, as a function of the ambient air temperature in the print unit dampening system 105 so that $T_{REF}$ is set to be equal to the ambient air temperature. The programmable control unit 110*a* thus receives the signals $T_A$, $T_F$, $T_{WO}$, and $T_{WI}$ and then outputs a control signal to the respective components of the isothermal dampener system 100 according to the present invention based on the desired temperature for the system, $T_{REF}$, and the current temperatures in each component of the system.

For example, the control signal could be the value of $T_{REF}$ which, when received by a particular component, would cause that component to be cool down or heat up, as appropriate, to achieve the value of $T_{REF}$. For example, the air temperature control unit 125, the dampener fluid temperature control unit 115 and the roller cooling temperature control unit 120 each receive the control signal and then respond thereto e.g., adjust their respective operating conditions to cool down or heat up as necessary, via, for example, their respective heater/chiller units and circulation systems. Alternatively, the temperature control unit 110 can send an individual heat or cool control signal to each component of the isothermal dampener system 100 instead of a single control signal to each component, the individual control signal being determined as a function of $T_{REF}$ to cause the appropriate temperature adjustment in the receiving unit.

Figure 2:
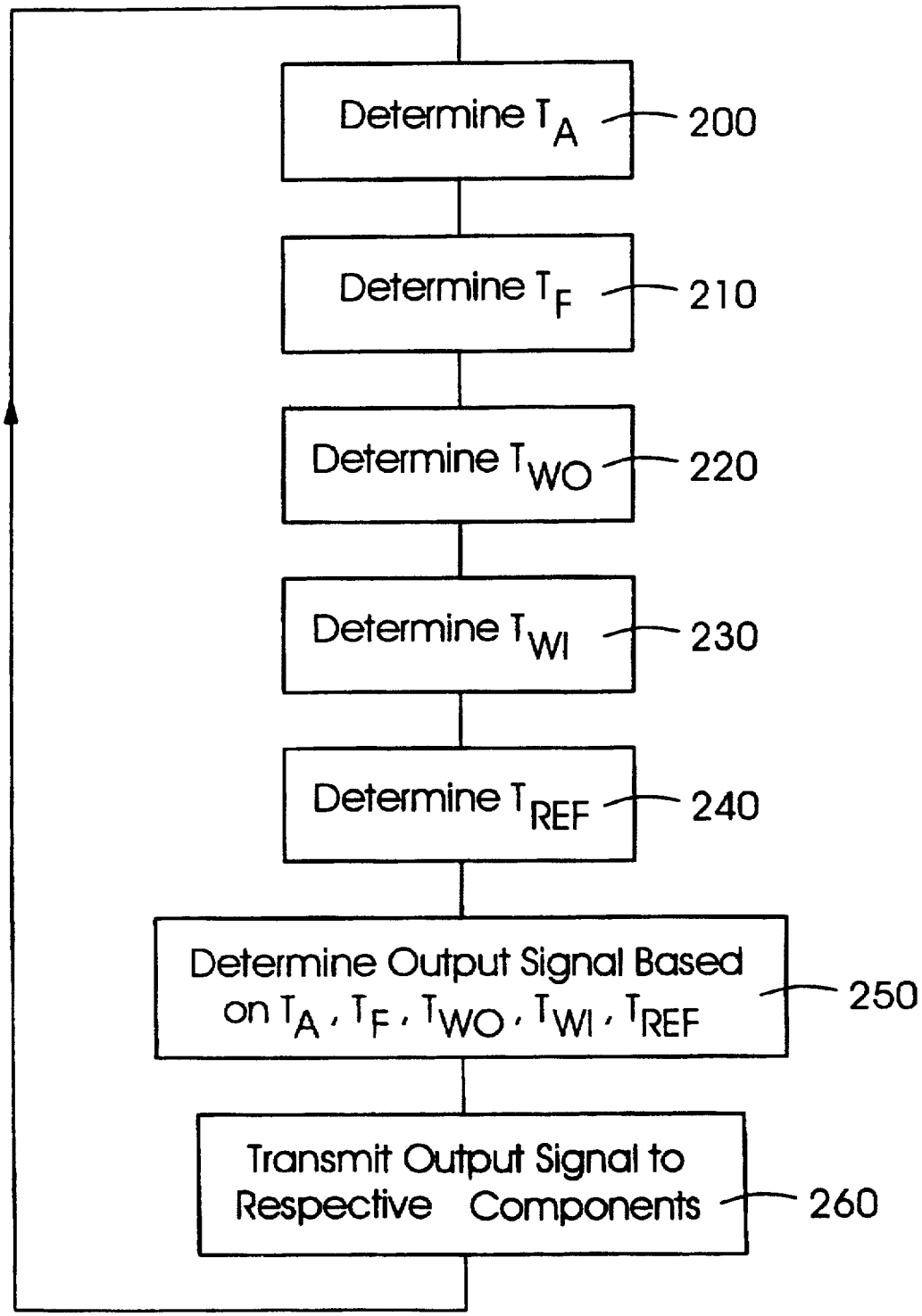
FIG. 2 is an exemplary flow chart for a method of creating a substantially isothermal condition according to the present invention.

FIG. 2 illustrates an exemplary process for creating an isothermal condition according to the present invention. For example in step 200, the ambient air temperature, $T_A$, is determined. In step 210, the temperature of the dampening fluid, $T_F$, is determined. In steps 220 and 230, the temperature of the roller cooling water outlet and inlet, respectively, are determined. In step 240, the reference temperature, $T_{REF}$, is determined, either based on the ambient air temperature or a predetermined value. As will be apparent to those skilled in the art, steps 200 to 240 can be performed in any sequence or could even be performed simultaneously. In step 250, the output signal is determined as a function of at least one of $T_A$, $T_F$, $T_{WO}$, $T_{WI}$ and $T_{REF}$ and provided to components 115, 120 and 125 which can adjust their respective temperatures in response to the control signal so that a substantially isothermal condition is maintained for the print unit dampening system 105.

Accordingly, the control signal from the temperature control unit 110 according to the present invention causes the temperatures of the dampening system rollers, the dampening fluid and the air in the area of the dampening system to be controlled so that the temperatures are substantially equal e.g., so that a substantially isothermal condition exists, each of the components of the isothermal dampening system 100 having a similar and constant temperature. For example, the fan of the air temperature control unit 125 can be controlled in response to the control signal to circulate air through the print unit dampening system 105, the circulated air being heated or cooled by the heater or chiller of the air temperature control unit 125, if necessary. Similarly, the heater or chiller of the roller cooling water temperature control unit 120 and the dampener fluid temperature control unit 115 can be controlled as a function of the control signal to control the temperature of the roller cooling water and dampening fluid, respectively (via the respective reservoir tank and pumping systems) that is circulated through the isothermal dampener system 100 so that the temperatures of the dampening system rollers, the dampening fluid and the air in the area of the dampening system are substantially equal.

As noted earlier, air temperatures slightly above or below the temperature of the dampening fluid and the temperature of the dampening roller surfaces provide a low and acceptable level of evaporation of dampening fluid or condensation onto the roller surface. Accordingly, by measuring the temperature of the dampening liquid, dampening roller cooling water and ambient air temperature and varying the air and component temperatures by, for example, cooling or heating the air or fluids in the system according to the present invention, the temperature difference between the components in the isothermal dampening system and the air becomes minimal. Thus, the result of maintaining temperatures in such an acceptable range manner will result in minimal condensation in the system and, for example, a consistent delivery of dampening solution to the printing plate.

What is claimed is:

1. An isothermal dampener system, comprising:

a print unit dampening system;

an air temperature control unit coupled to the print unit dampening system;

a dampener fluid temperature control unit coupled to the print unit dampening system;

a roller cooling temperature control unit coupled to the print unit dampening system; and a temperature control unit coupled to the print unit dampening system, the air temperature control unit, the dampener fluid temperature control unit and the roller cooling temperature control unit, the temperature control unit including a programmable control unit;

wherein the programmable control unit of the temperature control unit receives an air temperature input signal, a dampening fluid temperature input signal, a roller cooling water outlet temperature input signal and a roller cooling water inlet temperature input signal and determines a control signal as a function of at least one of the air temperature input signal, the dampening fluid temperature input signal, the roller cooling water outlet temperature input signal and the roller cooling water inlet temperature input signal and a predetermined reference temperature signal, a temperature of each of the air temperature control unit, the dampener fluid temperature control unit and the roller cooling temperature control unit being adjusted as a function of the control signal to obtain a substantially isothermal condition.

2. The isothermal dampener system according to claim 1, wherein the predetermined reference temperature signal is determined by one of a predetermined temperature and the air temperature input signal.

3. The isothermal dampener system according to claim 1, wherein the print unit dampening system is substantially isolated from ambient air conditions.

4. The isothermal dampener system according to claim 1, wherein the programmable control unit includes a microprocessor-based computing device.

5. A method for preventing condensation in a machine processing a web of material, comprising the steps of:

determining an ambient air temperature in a print unit dampening system;

determining a dampening fluid temperature;

determining a roller cooling water outlet temperature;

determining a roller cooling water inlet temperature;

determining a reference temperature;

determining a control signal as a function of at least one of the ambient air temperature, the dampening fluid temperature, the roller cooling water outlet temperature, the roller cooling water inlet temperature and the reference temperature; and controlling the ambient air temperature, the dampening fluid temperature, the roller cooling water outlet temperature and the roller cooling water inlet temperature as a function of the reference temperature to establish a substantially isothermal condition.

6. The method according to claim 5, wherein the step of determining the reference temperature includes determining the reference temperature as a function of one of a predetermined temperature and the ambient air temperature.

* * * * *